US012181183B2

(12) United States Patent
Huang et al.

(10) Patent No.: US 12,181,183 B2
(45) Date of Patent: Dec. 31, 2024

(54) GAS VALVE AND GAS BURNER SYSTEM

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 357 days.

(21) Appl. No.: 17/570,684

(22) Filed: Jan. 7, 2022

(65) Prior Publication Data

US 2023/0221038 A1 Jul. 13, 2023

(51) Int. Cl.

| | |
|---|---|
| ***F16K 15/03*** | (2006.01) |
| ***F23N 1/08*** | (2006.01) |
| ***F24D 17/00*** | (2022.01) |
| ***F24D 19/10*** | (2006.01) |
| ***F24H 9/20*** | (2022.01) |

(52) U.S. Cl.

CPC ..... *F24H 9/2035* (2013.01); *F23N 1/087* (2013.01); *F24D 17/0026* (2013.01); *F24D 17/0089* (2013.01); *F24D 19/1009* (2013.01)

(58) Field of Classification Search

CPC ..... F16K 15/063; F16K 15/028

See application file for complete search history.

(56) References Cited

U.S. PATENT DOCUMENTS

| | | | | |
|---|---|---|---|---|
| 2015/0114313 | A1 | 4/2015 | Huang et al. | |
| 2018/0299055 | A1* | 10/2018 | Thomas | F16L 37/40 |
| 2019/0383407 | A1* | 12/2019 | Mclean Pe | F16K 15/063 |

FOREIGN PATENT DOCUMENTS

| | | | |
|---|---|---|---|
| CN | 108518508 | A | 9/2018 |
| TW | M246542 | U | 10/2004 |
| TW | M455108 | U | 6/2013 |
| TW | I529357 | B | 4/2016 |
| TW | M626831 | | 5/2022 |
| WO | 2016131465 | A1 | 8/2016 |
| WO | 2021016125 | A1 | 1/2021 |

OTHER PUBLICATIONS

Search Report for EP22207482, Issued on May 16, 2023, Total of 1 page.

(Continued)

*Primary Examiner* — P. Macade Nichols

(74) *Attorney, Agent, or Firm* — Apex Juris, pllc; R. Lynette Wylie

(57) ABSTRACT

A gas valve for a gas appliance of a gas burner system. The gas valve is connected to a gas source via a gas pipe. The gas valve is disposed with a check valve body, wherein the check valve body allows gas in the gas pipe to flow into the gas valve and prohibits the gas in the gas valve to flow into the gas pipe so the check valve body can thereby prevent the gas in the gas valve from flwoing back to the gas pipe. When gas in the gas pipe flows to to another gas appliance of the gas burner system, the gas flowing to another gas appliance does not mix with air in the gas appliance, thereby reducing the iginition time and enhancing the combustion efficiency.

4 Claims, 12 Drawing Sheets

(56) References Cited

OTHER PUBLICATIONS

Search Report for TW110144956, Issued Jul. 1, 2022, Total of 1 page.
Translation of Abstract of CN108518508, Total of 1 page.
Translation of Abstract of TWI529357, Total of 1 page.
Translation of Abstract of TWM455108, Total of 1 page.
Translation of Abstract of TWM246542, Total of 1 page.
Translation of Abstract of TWM626831, Total of 1 page.

* cited by examiner

GAS VALVE AND GAS BURNER SYSTEM

BACKGROUND OF THE INVENTION

Technical Field

The present invention relates generally to a gas valve, and more particularly to a gas valve and/or a gas burner system having a check valve body.

Description of Related Art

The gas burner system includes a plurality of gas appliances, wherein the gas appliances are connected to the same gas pipe and could be turned on individually to combust gas. Take a hot water supply system as an example, the conventional hot water supply system includes a plurality of water heaters as the gas appliance. Each of the water heaters has an inlet section, an outlet section, a gas pipes. The inlet sections of the water heaters are connected to the same water supply tube. The outlet sections of the water heaters are connected to an outlet tube to supply hot water to a plurality of taps. The gas pipes of the water heaters are connected to the same gas pipe in parallel. The control unit could control each of the water heaters to be turned on or off, so that the hot water supply system could provide enough amount of hot water for users. In other words, the control unit could control the on and off of the water heater according to the demand for hot water.

However, the more water heaters are connected, the less purity of gas received by the water heater approaching a distal end of the gas pipe, which leads to a long ignition time. For example, when the water heater approaching the distal end is turned on, but the water heater approaching the gas source is not activated, the gas flow in the gas pipe could draw the air in the water heater approaching the gas source into the gas pipe, leading the purity of the gas in the gas pipe is reduced. Since the gas flowing into the water heater approaching the distal end of the gas pipe is mixed with air, in the water heater approaching the distal end of the gas pipe, the ignition time is longer and the combustion efficiency is poor.

Therefore, the conventional gas burner system has room for improvement.

BRIEF SUMMARY OF THE INVENTION

In view of the above, the primary objective of the present invention is to provide a gas burner system that could prevent gas/air from flowing through the gas appliance back to the gas pipe connected to the gas source.

The present invention provides a gas burner system connected to a gas source. The gas burner system includes a plurality of gas appliances, a plurality of gas pipes. Each of the gas appliances includes a burner for burning gas, and the gas appliances include a first gas appliance and a second gas appliance. The gas pipes include a main pipe, a first gas pipe, and a second gas pipe. The main pipe is connected to the gas source. An end of the first gas pipe is connected to the main pipe, and another end of the first gas pipe is connected to the first gas appliance. An end of the second gas pipe is connected to the main pipe, and another end of the second gas pipe is connected to the second gas appliance. The first gas pipe is connected to the main pipe at a site that is closer to the gas source than a connection site between the second gas pipe and the main pipe. The first gas appliance includes a gas valve, wherein the gas valve communicates with the burner of the first water heater and includes an inlet channel. The end of the first gas pipe is connected to the main pipe, the another end of the first gas pipe is connected to the inlet channel of the first gas appliance. The check valve body is disposed in the inlet channel of the gas valve, wherein the check valve body includes an elastic member and a sealing member; the elastic member provides a supporting force to the sealing member to block the inlet channel, so that gas in the gas valve is prevented from flowing back to the first gas pipe. When gas flows in the first gas pipe toward the gas valve, the gas flow provides a force against to the supporting force to move the sealing member, thereby allowing the gas to flow through the check valve body.

The present invention provides a gas valve for a gas appliance, wherein the gas vlave communicates with a gas source via a gas pipe. The gas valve includes an inlet channel and a check valve body. The inlet channel communicates with the gas pipe. The check valve body is disposed in the inlet channel of the gas valve and includes an elastic member and a sealing member, wherein the elastic member provides a supporting force to the sealing member to block the inlet channel. When gas flows toward the gas valve, the gas flow provides a force against the supporting force to move the sealing member, thereby allowing the gas to flow through the check valve body.

With such design, the air/gas in the gas valve could not flow back to the first gas pipe or the gas pipe through the check valve body. Therefore, when the gas flowing to the second gas appliance, the gas is not mixed with the air coming from the first gas appliance, thereby reducing the ignition time of the second gas appliance and improving the combustion efficiency of the second gas appliance.

BRIEF DESCRIPTION OF THE SEVERAL VIEWS OF THE DRAWINGS

The present invention will be best understood by referring to the following detailed description of some illustrative embodiments in conjunction with the accompanying drawings, in which

FIG. 6 is similar to FIG. 5, showing the check valve body is opened for the gas to pass through:

DETAILED DESCRIPTION OF THE INVENTION

As illustrated in FIG. 1 to FIG. 8, a gas burner system of an embodiment according to the present invention is a hot water supply system 1 as an example. The hot water supply system 1 is connected to a gas source G that is natural gas and is supplied by a gas company.

Figure 1:
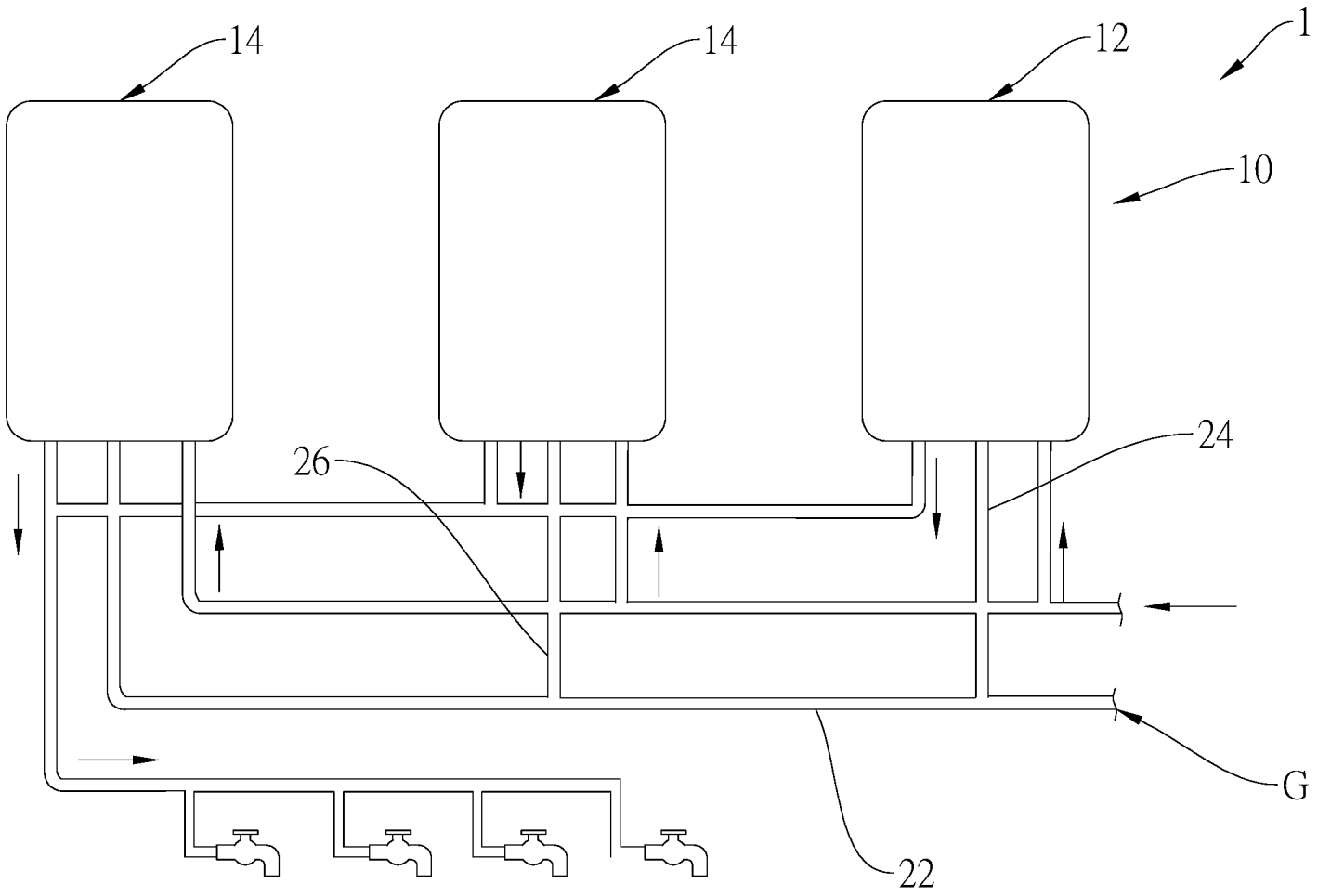
FIG. 1 is a schematic view of the hot water supply system of an embodiment according to the present invention.

As illustrated in FIG. 1, the hot water supply system 1 includes a gas appliance and a plurality of gas pipes, wherein the gas appliance includes a plurality of water heaters 10 as an example. The water heaters 10 includes a first water heater 12 as a first gas appliance and at least one second water heater 14 as at least one second gas appliance. Each of the gas appliances includes a burner for burning gas. The gas pipes include a main pipe 22 and a plurality of branching pipes that is connected to the main pipe 22, wherein an end of the main pipe 22 is connected to the gas source G, and the other end of the main pipe 22 (namely an end opposite to the end connected to the gas source G) is defined as a distal end. The branching pipes include at least one first gas pipe 24 and at least one second gas pipe 26. An end of the first gas pipe 24 communicates with the main pipe 22, the other end of the first gas pipe 24 communicates with the first water heater 12. An end of the second gas pipe 26 communicates with the main pipe 22, the other end of the second gas pipe 26 communicates with the second water heater 14. The first gas pipe 24 is connected to the main pipe 22 at a site that is closer to the gas source G than any connection site between the second gas pipe 26 and the main pipe 22. Besides, as illustrated in FIG. 1, as long as the connection site of any branching pipe is relative to the gas source G farther than the site where the first gas pipe 24 is connected to the main pipe 22, the water heater 10 connected to said branching pipe is defined as the second water heater 14. In the embodiment, the at least one second water heater 14 includes a plurality of second water heaters.

Figure 2:
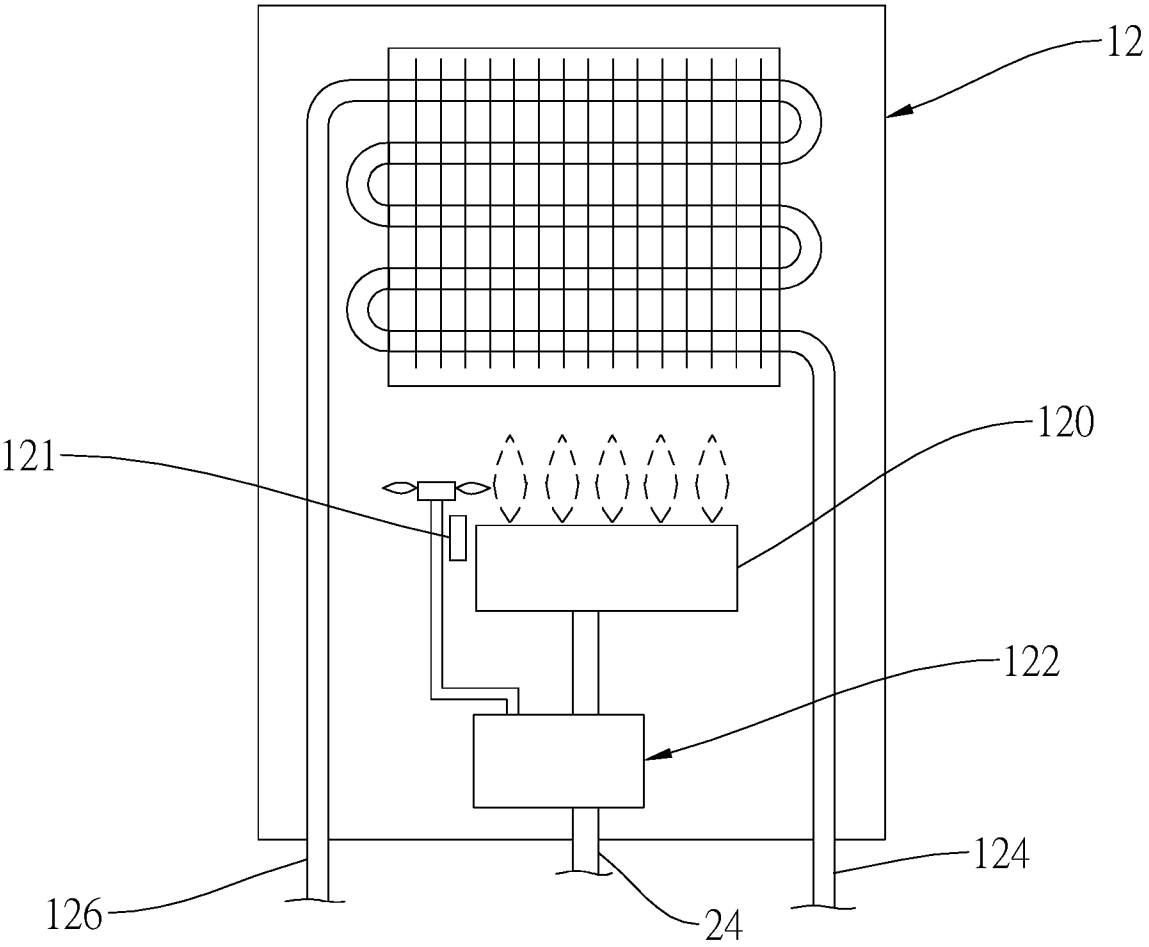
FIG. 2 is a schematic view of the water heater of the embodiment according to the present invention.
Figure 3A:
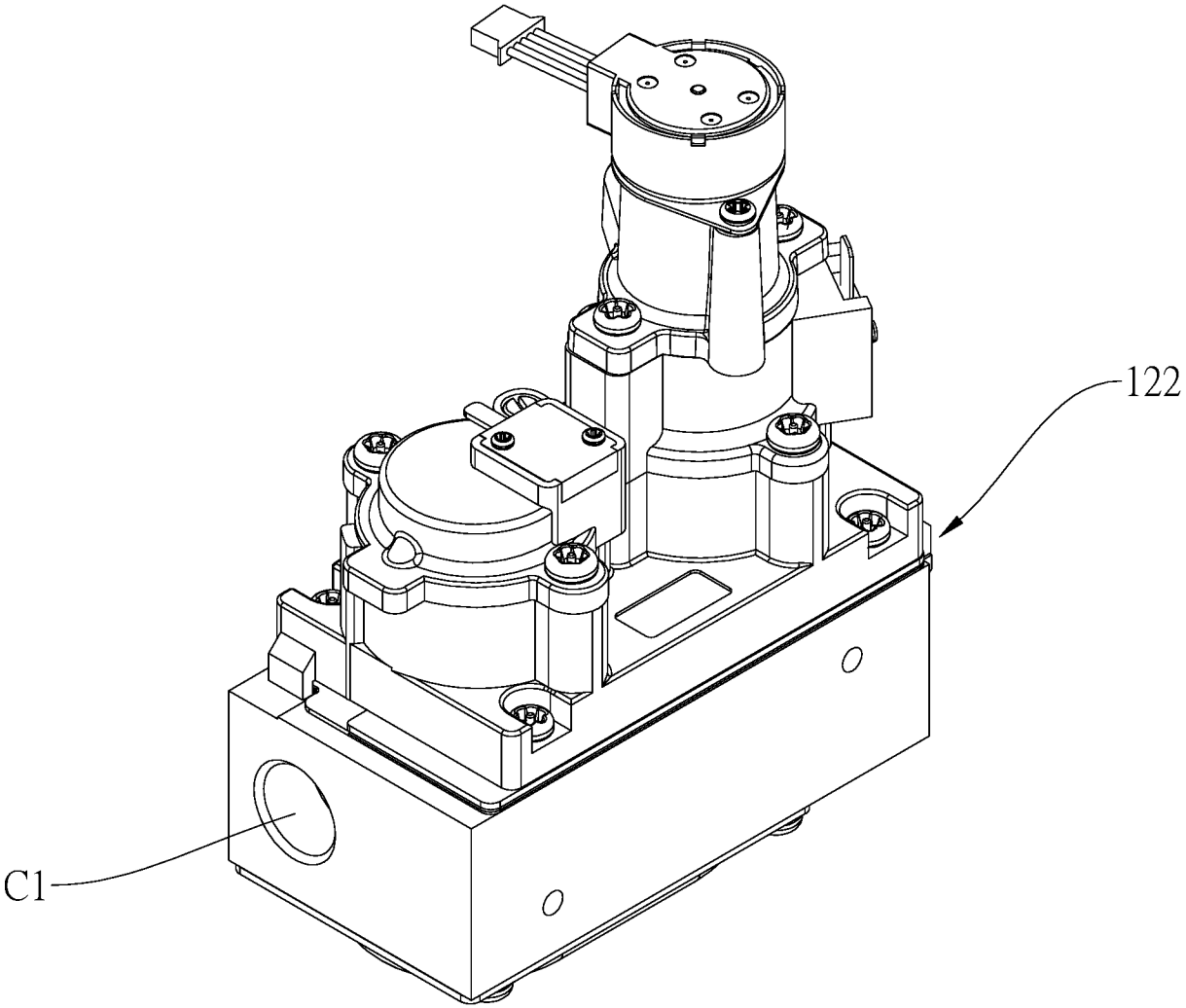
FIG. 3A is a perspective view of the gas valve of the embodiment according to the present invention.
Figure 3B:
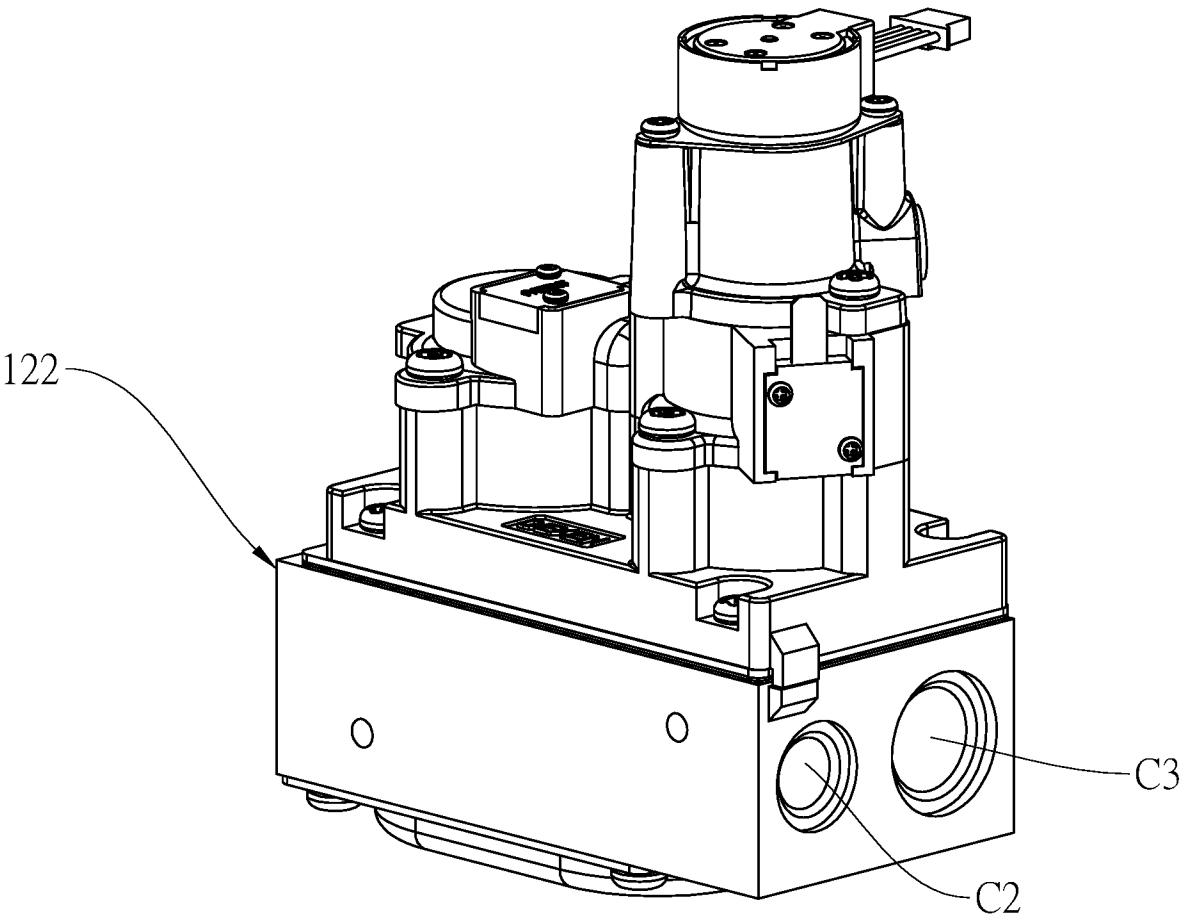
FIG. 3B is a perspective view of the gas valve of an embodiment according to the present invention seen from another perspective.

As illustrated in FIG. 2, the first water heater 12 includes a gas valve 122, a burner 120, and an ignitor 121. In the current embodiment, an end of the first gas pipe 24 communicates with the first gas pipe 24, the other end of the first gas pipe 24 communicates with the gas valve 122. The burner 120 includes a main burner and a pilot burner, wherein the burner 120 is adapted to burn the gas outputted through the gas valve 122 to generate flame, thereby heating water that is inputted through an inlet section 124 in the first water heater 12. After the water is heated in the first water heater 12, the water is outputted through an outlet section 126.

A check valve body 30 is disposed in the gas valve 122 and is adapted to allow gas flowing into the gas valve 122 through the first gas pipe 24 and to prohibit gas in the gas valve 122 from flowing back to the first gas pipe 24. Therefore, when the at least one second water heater 14 that approaches the distal end of the main pipe 22 is operated and the first water heater 12 that approaches the gas source G is not operated, gas/air in the gas valve 122 of the first water heater 12 is unable to flow back the first gas pipe 24 through the check valve body 30. With such design, even though gas keeps flowing toward the second water heater 14, the gas flowing into the second water heater 14 does not mix with gas/air in the first water heater 12, thereby reducing an ignition time or improving the combustion efficiency of the second water heater 14.

In the current embodiment, the check valve body 30 is disposed in the gas valve 122 of the first water heater 12. However, the check valve body 30 is not limited to being disposed in the first water heater 12. The gas valve of each of the water heaters could be disposed with the check valve body 30. For example, as illustrated in FIG. 1, the second water heater 14 which is located between the first water heater 12 and the other second water heater 14 could be disposed with the check valve body 30. Alternatively, each of the second water heaters 14 could be disposed with a gas valve as that of the first water heater 12.

As illustrated in FIG. 3 to FIG. 6, the gas valve 122 includes an inlet channel C1 communicating with the first gas pipe 24. The check valve body 30 is disposed in the inlet channel C1 and includes an elastic member 31 and a sealing member 32. The elastic member 31 provides a supporting force to urge the sealing member 32 to block the inlet channel C1. When the elastic member 31 is pushed by a force greater than the supporting force, the sealing member 32 is moved to allow gas in the inlet channel C1 to flow through the check valve body 30.

More specifically, the check valve body 30 includes a seat 33 and a guided rod 34. The seat 33 is disposed in the inlet channel C1 and has a protruding column 331, wherein the protruding column 331 has a perforation 332. An end of the guided rod 34 is movably inserted into the perforation 332, and the other end of the guided rod 34 is connected to the sealing member 32. The sealing member 32 has a hole 321. The end of the guided rod 34 connected to the sealing member 32 has a head 341 and a restricting portion 342. The guided rod 34 passes through the hole 321 of the sealing member 32, and the sealing member 32 is located between the head 341 and the restricting portion 342 of the guided rod 34. A diameter of the head 341 and a diameter of the restricting portion 342 are greater than a diameter of the hole 321 of the sealing member 32. The diameter of the restricting portion 342 is greater than a diameter of the perforation 332 of the seat 33.

Figure 5:
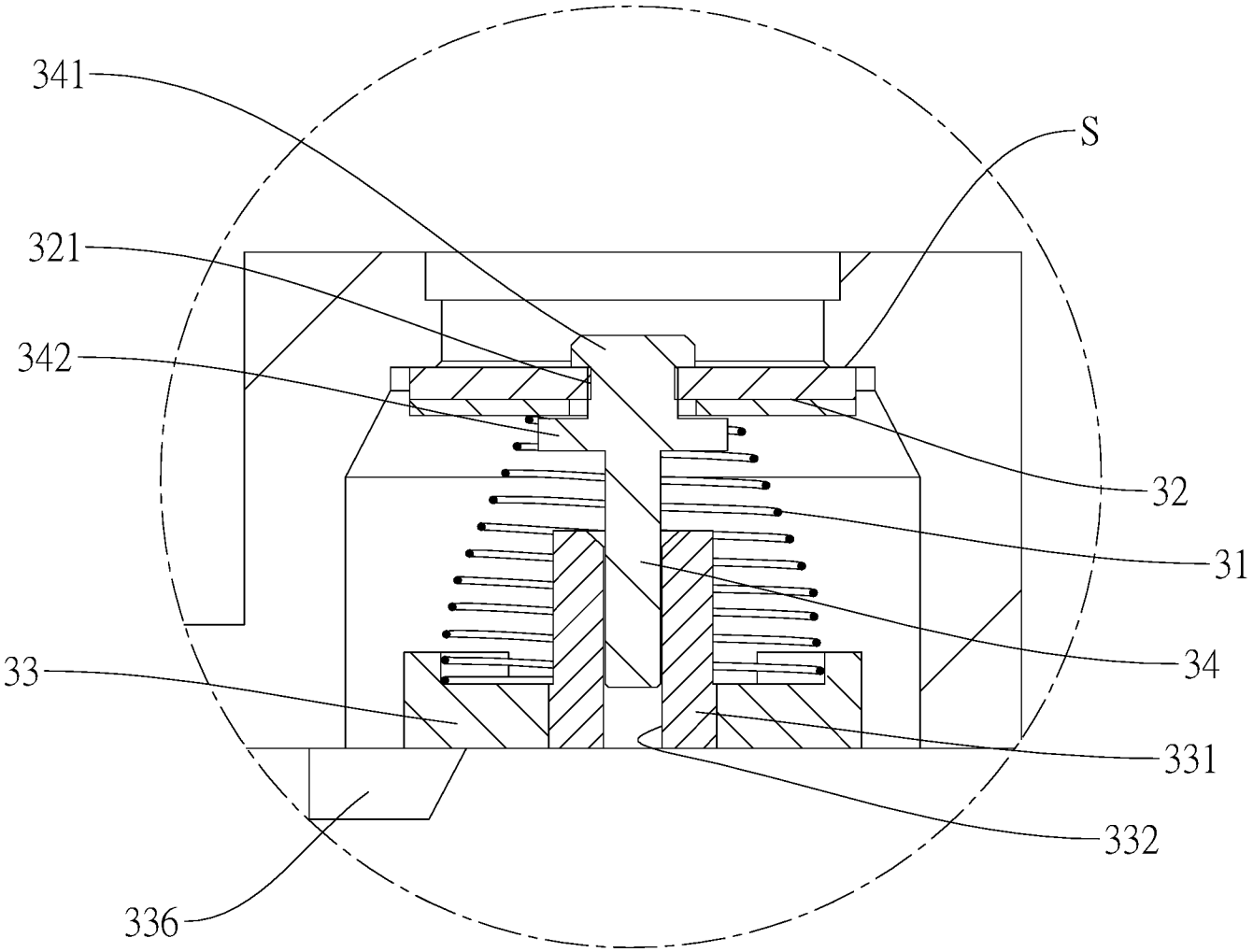
FIG. 5 is an enlarged partial view of a marked region in FIG. 4.
Figure 6:
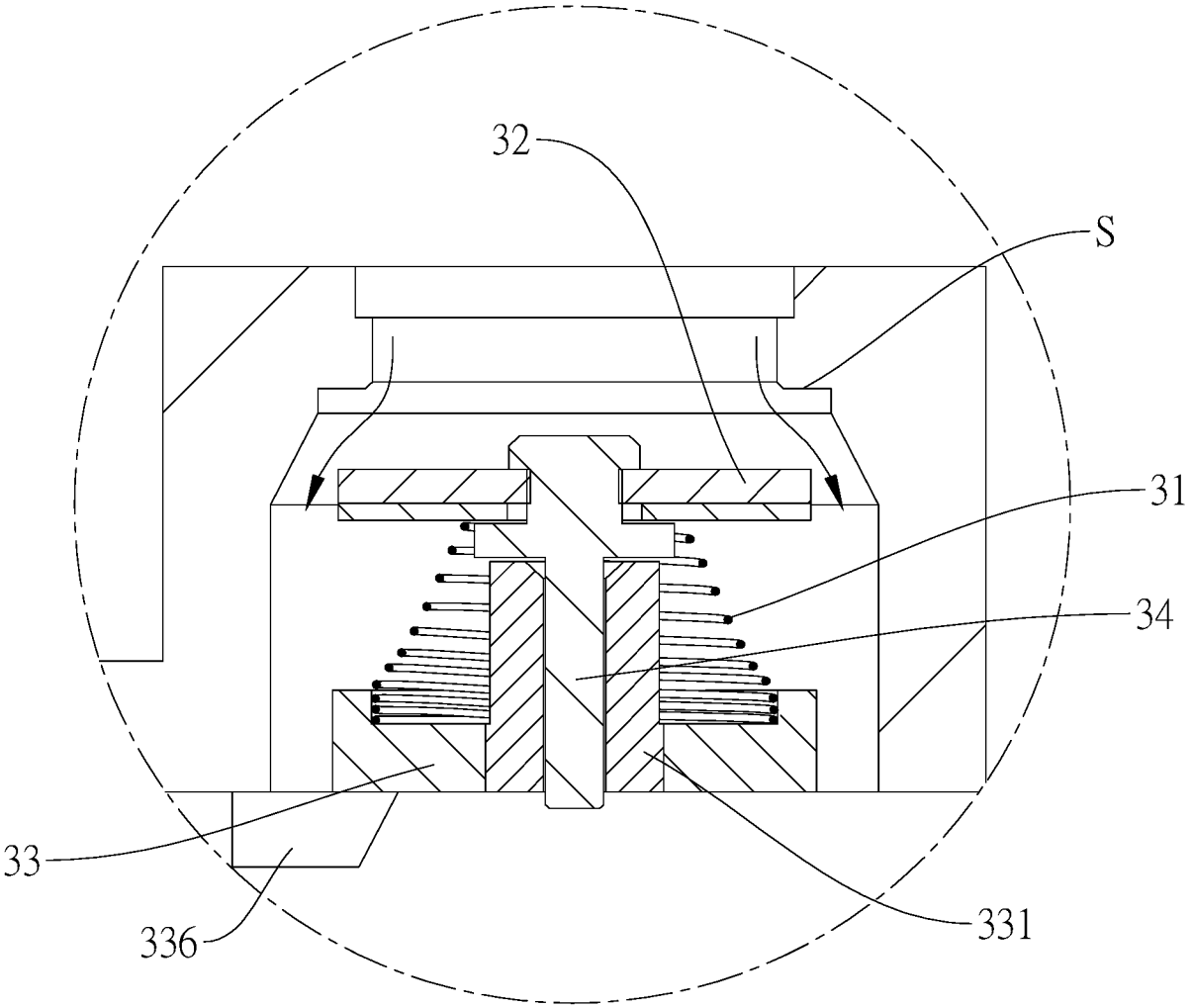

The inlet channel C1 has a shoulder S. The elastic member 31 fits around the guided rod 34 and the protruding column 331. An end of the elastic member 31 urges against the sealing member 32, the other end of the elastic member 31 urges against the seat 33. In the current embodiment, the elastic member 31 is a conical compression spring, wherein a diameter of the conical compression spring is gradually increased from the end of the elastic member 31 urging against the sealing member 32 to the end of the elastic member 31 urging against the seat 33. A side of the sealing member 32 abuts against the shoulder S, and an opposite side of the sealing member 32 is urged against by the elastic member 31, thereby blocking the inlet channel C1, as shown in FIG. 5. When the elastic member 31 is pushed by the force greater than the supporting force, the sealing member 32 disengaging from the shoulder S, thereby allowing gas in the inlet channel C1 could flow through the check valve body 30, as shown in FIG. 6.

When gas from the gas source G flows into the first gas pipe 24, the gas flow pushes the elastic member 31 via the sealing member 32. When a force exerted by the gas flow is greater than the supporting force, the sealing member 32 is moved to compress the elastic member 31, thereby allowing the gas in the inlet channel C1 could flow through the check valve body 30. On the contrary, when the force exerted by the gas flow is smaller than the supporting force exerted to the sealing member 32 by the elastic member 31, the elastic member 31 urges the sealing member 32 to return to abut against the shoulder S of the inlet channel C1, thereby preventing gas in the gas valve 122 from flowing back to the first gas pipe 24.

Figure 4:
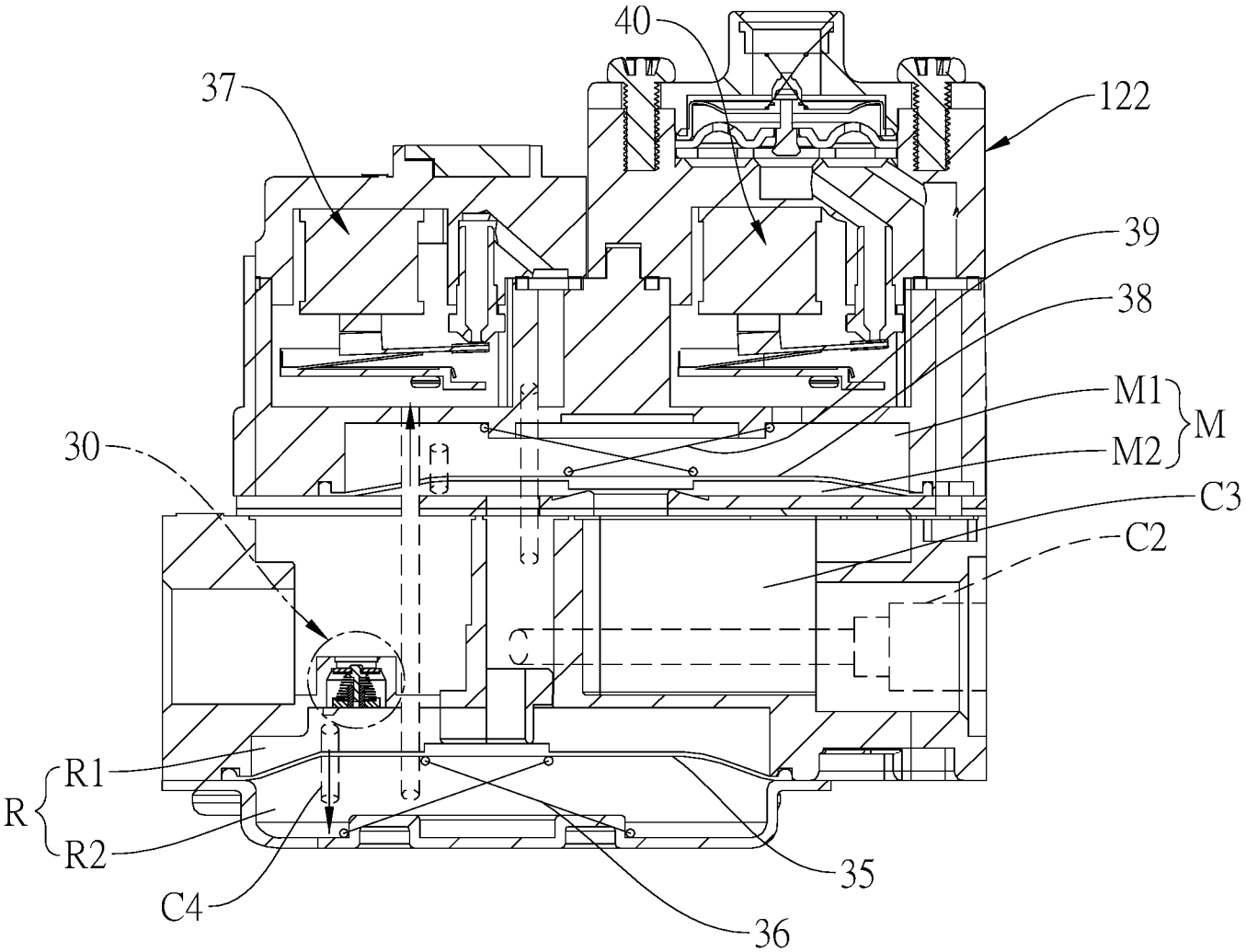
FIG. 4 is a schematic view of the gas valve of the embodiment according to the present invention.
Figure 7:
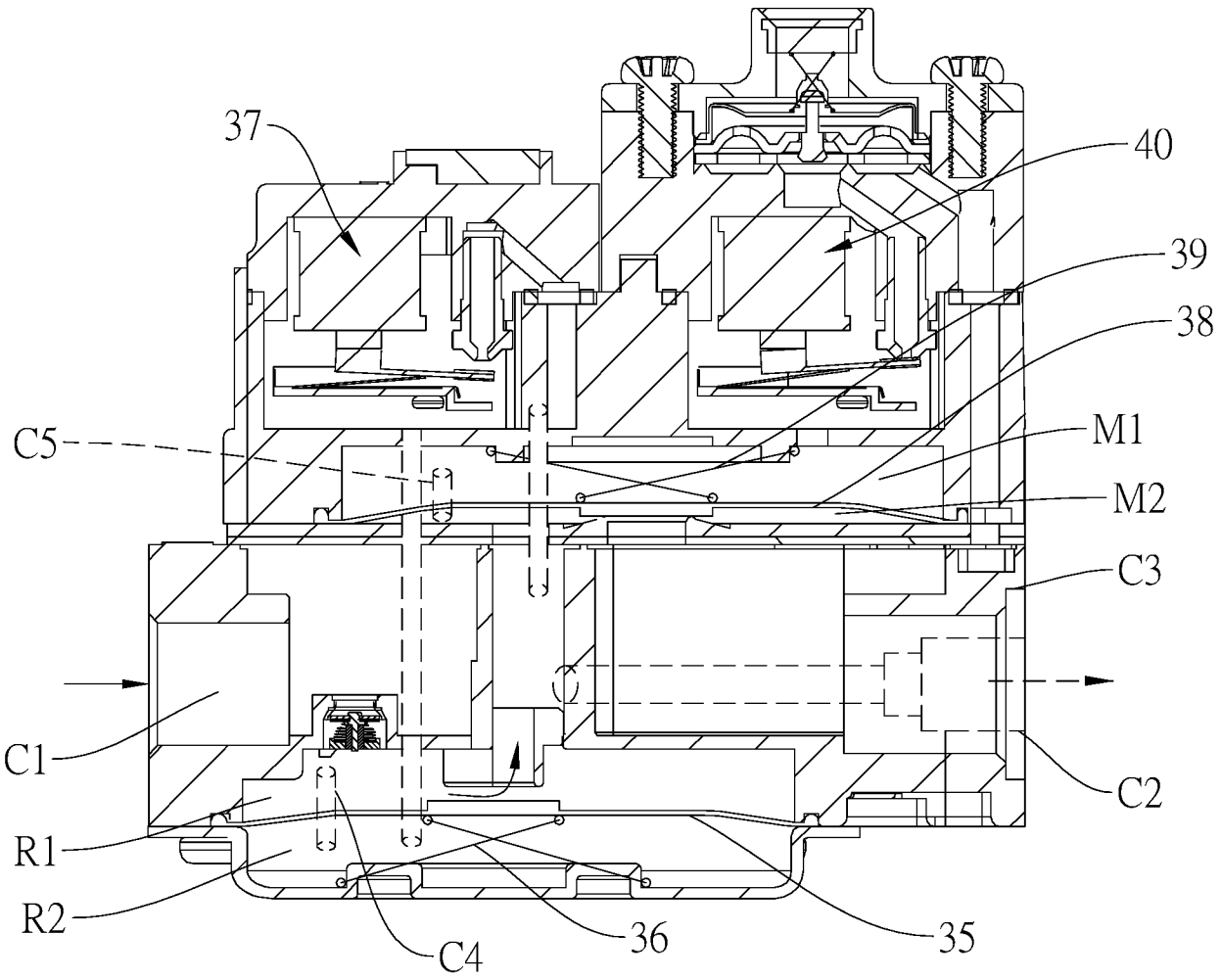
FIG. 7 is a schematic view of the gas valve of the embodiment according to the present invention, showing the first isolating membrane is moved downward to allow the first part of the inlet chamber to communicate with the outlet tube for the pilot burner.
Figure 8:
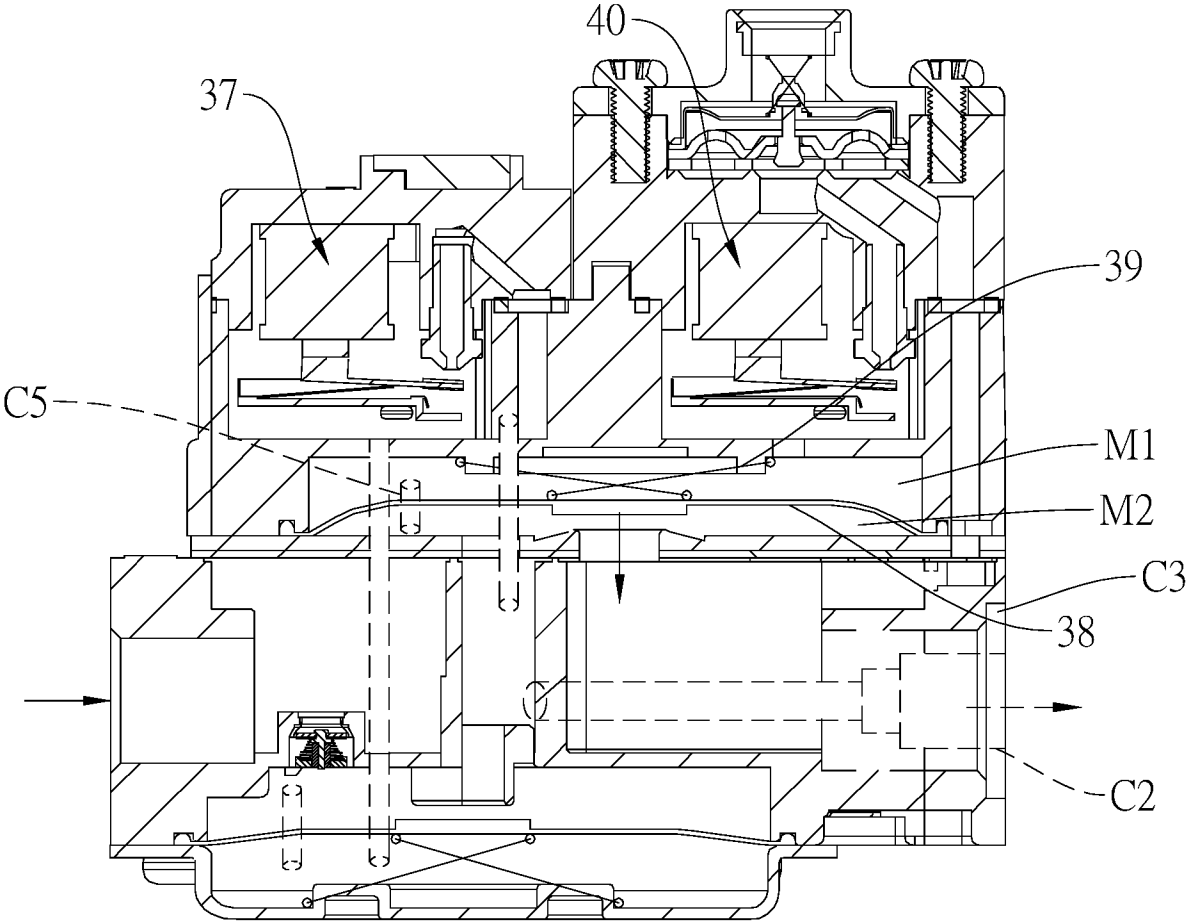
FIG. 8 is a schematic view of the gas valve of the embodiment according to the present invention, showing the second isolating membrane is moved upward to allow the second part of the main gas chameber to communicate with the outlet tube for the main burner.

As illustrated in FIG. 4 and FIG. 7 to FIG. 8, the gas valve 122 includes an inlet chamber R, a first isolating membrane 35, a first elastic member 36, a first electromagnetic valve 37, a first outlet channel C2, a main gas chamber M, a second isolating membrane 38, a second elastic member 39, a second electromagnetic valve 40, and a second outlet channel C3, wherein each of the first elastic member 36 and the second elastic member 39 is a spring. The first electromagnetic valve 37 is adapted to control a gas flow to the pilot burner, and the first outlet channel C2 is adapted to supply gas to the pilot burner. The second electromagnetic valve 40 is adapted to control a gas flow to the main burner, and the second outlet channel C3 is adapted to supply gas to the main burner.

The inlet channel C1 communicates the first gas pipe 24 and the inlet chamber R, wherein the first isolating membrane 35 is disposed in the inlet chamber R to divide the inlet chamber R into a first part R1 and a second part R2 that communicates with the first part R1. An end of the first elastic member 36 abuts against an inner wall of the second part R2 of the inlet chamber R, another end of the first elastic member 36 abuts against the first isolating membrane 35. The first electromagnetic valve 37 is adapted to regulate a communication between the second part R2 of the inlet chamber R and the first outlet channel C2, namely communicating and blocking. A side of the first isolating membrane 35 is urged against by the first elastic member 36 to block a communication between the first part R1 of the inlet chamber R and the first outlet channel C2.

The second isolating membrane 38 is disposed in the main gas chamber M to divide the main gas chamber M into a first part M1 and a second part M2 that communicates with the first part M1. An end of the second elastic member 39 abuts against an inner wall of the second part M2, the other end of the second elastic member 39 abuts against the second isolating membrane 38. The second electromagnetic valve 40 is adapted to regulate a communication between the first part M1 of the main gas chamber M and the second outlet channel C3, namely communicating and blocking. A side of the second isolating membrane 38 is urged against by the second elastic member 39 to block a communication between the second part M2 of the main gas chamber M and the second outlet channel C3.

With such design, gas in the inlet channel C1 could flow through the check valve body 30 to enter the first part R1 of the inlet chamber R. After that the gas could enter to the second part R2 from the first part R1 of the inlet chamber R via a tube C4, wherein the tube C4 communicates the first part R1 and the second part R2 of the inlet chamber R. The first electromagnetic valve 37 is a normally closed solenoid valve. When the first electromagnetic valve 37 is operated to turn on, the second part R2 of the inlet chamber R communicates with the first outlet channel C2. The second part R2 of the inlet chamber R communicates with the second part M2 of the main gas chamber M. Gas could enter the first part M1 from the second part M2 of the main gas chamber M via another tube C5, wherein the another tube C5 communicates the first part M1 and the second part M2 of the main gas chamber M. At this time, the gas could be outputted through the first outlet channel C2 to the pilot burner, and a pilot flame is ignited by the ignitor 121. Additionally, when the first electromagnetic valve 37 is turned on, a pressure in the second part R2 of the inlet chamber R is smaller than a pressure in the first part R1 of the inlet chamber R. The pressure difference in the inlet chamber R could move the first isolating membrane 35 downward to compress the first elastic member 36 and to allow the first part R1 of the inlet chamber R communicates with the first outlet channel C2.

The second electromagnetic valve 40 is a normally closed solenoid valve. When the second electromagnetic valve 40 is operated to turn on, the first part M1 of the main gas chamber M communicates with the second outlet channel C3. At this time, gas is outputted through the second outlet channel C3 to the main burner for combustion to generate a main flame. Additionally, when the second electromagnetic valve 40 is operated to turn on, a pressure of the first part M1 of the main gas chamber M is smaller than a pressure of the second part M2 of the main gas chamber M. The pressure difference in the main gas chamber M could move the second isolating membrane 38 upward to compress the second elastic member 39 and to allow the second part M2 of the main gas chamber M communicates with the second outlet channel C3.

Figure 9:
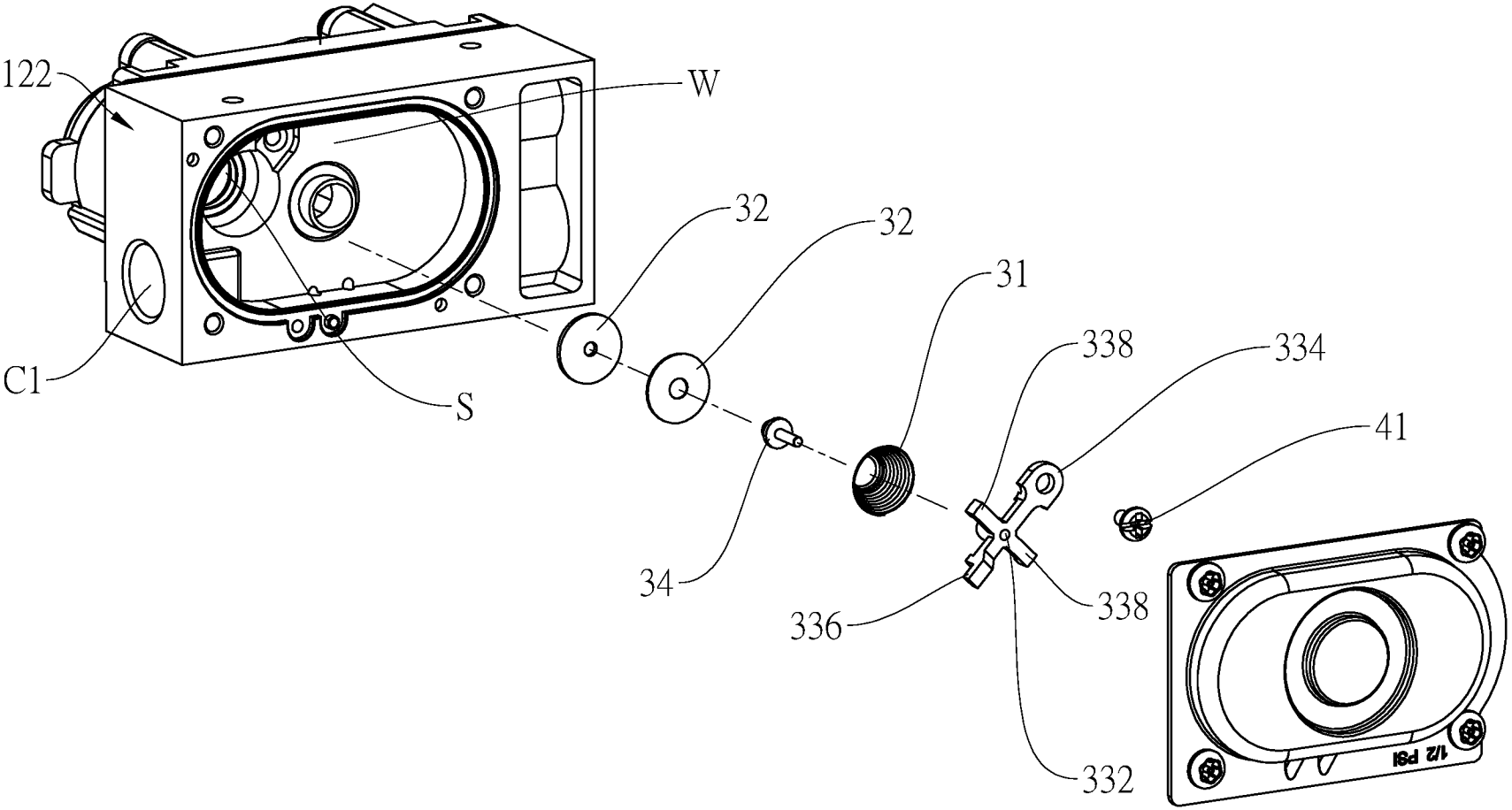
FIG. 9 is an exploded view of the component of the gas valve of the embodiment according to the present invention.
Figure 10:
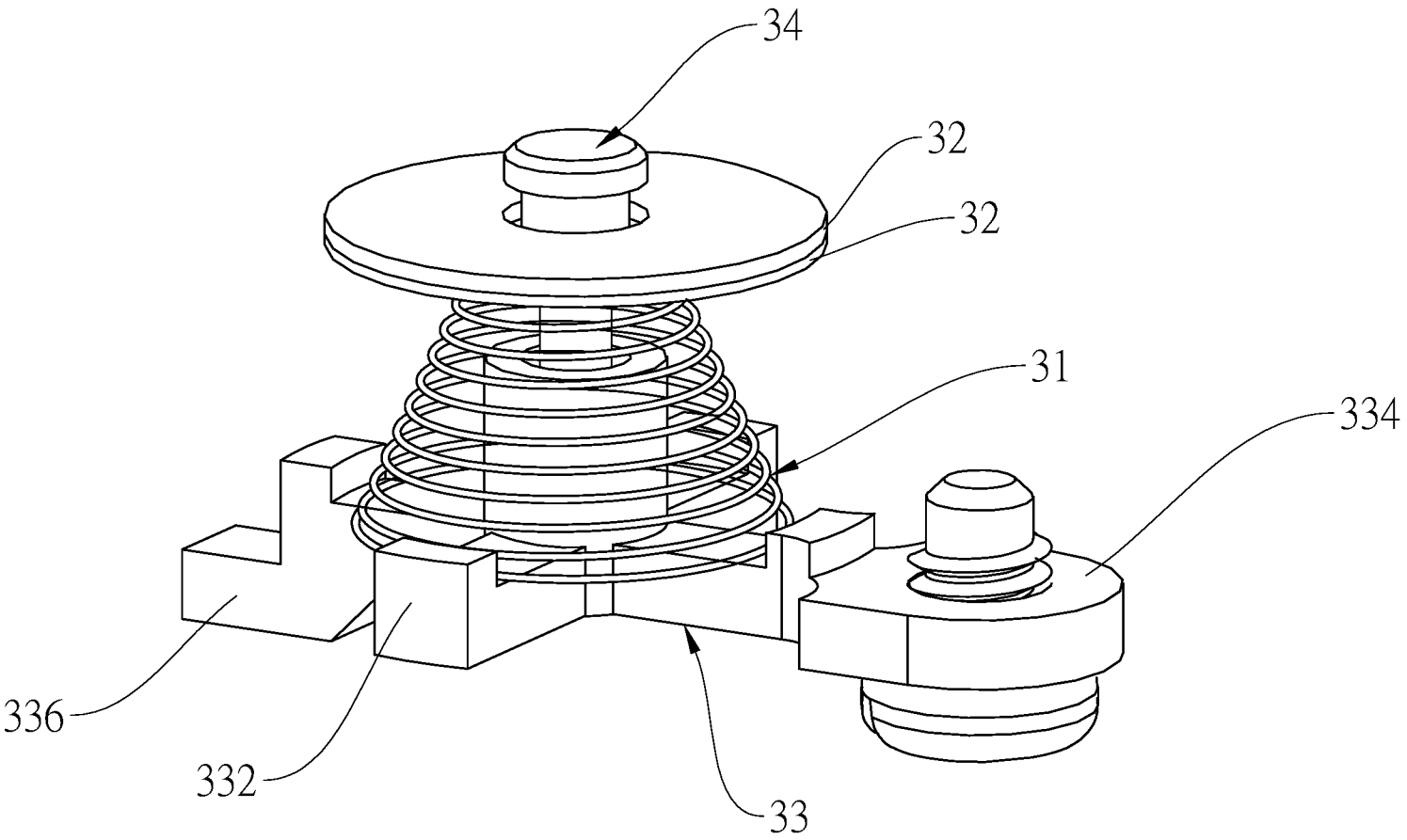
FIG. 10 is a perspective view of the check valve body of the gas valve of the embodiment according to the present invention; and, FIG. 11 is a schematic view of the valve of the embodiment according to the present invention, showing the check valve structure is mounted.
Figure 11:
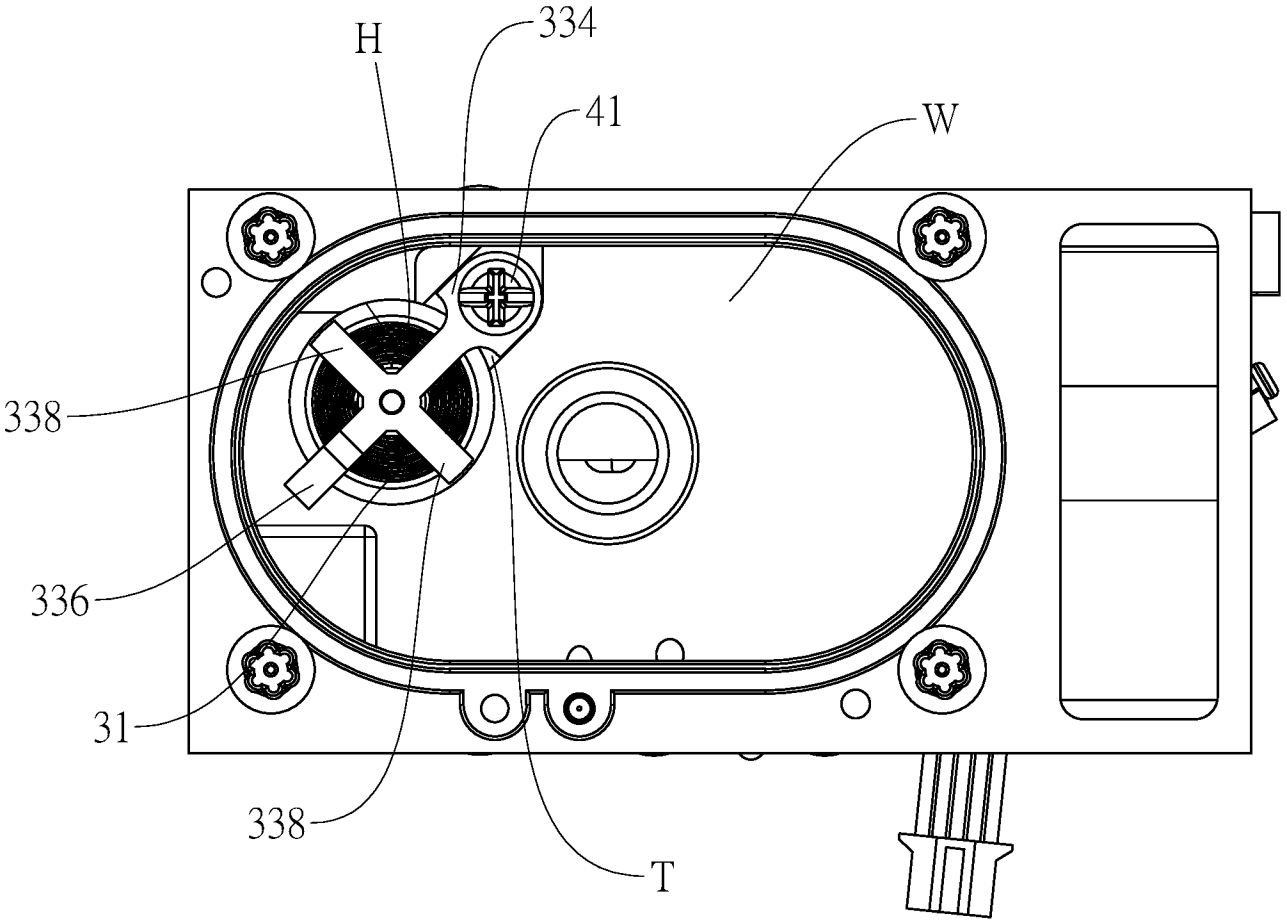

As illustrated in FIG. 9 to FIG. 11, the inlet channel C1 has a mounting hole H, wherein the shoulder S is located in the mounting hole H. The seat 33 has a first foot 334, a second foot 336, and two third feet 338, wherein the second foot 334 extends in an opposite direction of the first foot 334, and the two third feet 338 extend to oppsite directions. Each of the first foot 334 and the second foot 336 is perpendicular to one of the two third feet 338. Each of the first foot 334, the second foot 336, and the third feet 338 has a positioning portion, wherein the positioning portion is a portion of the seat 33 that is arranged around the elastic member 31 for preventing the elastic member 31 from moving, as illustrated in FIG. 10. When the check valve body 30 is disposed in the mounting hole H, the seat 33 is inserted into the mounting hole H. Besides, a side of the first foot 334, a side of the second foot 336, and sides of the third feet 338 that face a direction away from the elastic member 31 could abut against the inner wall of the mounting hole H, so that the check valve body 30 could be firmly mounted in the mounting hole H. Additionally, as illustrated in FIG. 11, an free end of the first foot 334 and a free end of the second foot 336 abuts against an internal wall W of the first part R1 of the inlet chamber R. The internal wall W has an engaging recess T that is formed by recessing into a surface of the internal wall W. A contour of the engaging recess T correspondingly complementary to the free end of the first foot 334. Thus, by simply engaging the free end of the first foot 334 with the engaging recess T, the seat 33 of the check valve body 30 could be quickly positioned and assembled. After that, fasteners such as screws 41 could be used to fix the seat 31 to the gas valve 122.

In the current embodiment, the gas valve 122 includes the inlet chamber R, the first isolating membrane 35, the first elastic member 36, the first electromagnetic valve 37, the first outlet channel C2, the main gas chamber M, the second isolating membrane 38, the second elastic member 39, the second electromagnetic valve 40, and the second outlet channel C3. However, in other embodiments, the main gas chamber M, the second isolating membrane 38, the second elastic member 39, the second electromagnetic valve 40, and the second outlet channel C3 of the gas valve 122 could be omitted. For example, in another embodiment, the gas valve could merely include an inlet chamber, an isolating membrane, a spring, a solenoid valve, an outlet channel, wherein the inlet channel communicates the first gas pipe and the inlet chamber. The isolating membrane is disposed in the inlet chamber to divide the inlet chamber into a first part and a second part. An end of the spring urges against the internal wall of the second part of the inlet chamber, and the other end of the spring abuts against the isolating membrane. The solenoid valve is adapted to regulate the communication between the second part of the inlet chamber and the outlet channel, namely communicating and blocking. A side of the isolating membrane is urged by the spring to block the communication between the first part of the inlet chamber and the outlet channel, so that gas in the inlet channel could pass through the check valve body 30 to enter the first part of the inlet chamber, and then the gas could enter the second part from the first part through a tube. The tube communicates the first part and the second part of the inlet chamber. The solenoid valve is a normally closed solenoid valve. When the solenoid valve is regulated to be turned on, the second part could communicate with the outlet channel. Therefore, gas could be outputted through the outlet channel to the burner and be ignited by the ignitor. When the solenoid valve is turned on, the pressure at the second part is smaller than the pressure in the first part of the inlet chamber, so that the isolating membrane could be moved toward the second part to compress the spring due to the difference of the pressure, thereby communicating the first part with the outlet channel.

To sum up, when the second water heater 14 that is located near to the distal end of the main pipe 22 is activated and the first water heater 12 that is located near to the gas source G is not activated, the check valve body 30 could prevent the gas in the gas valve 122 from flowing into the first gas pipe 24. Even though the gas flow rate of the gas flowing to the second water heater 14 is high in the gas tubes, the air in the first water heater 12 could not mix with the gas flowing to the second water heater 14, thereby solving the problem such as the long ignition time or the low combustion efficiency of the second water heater 14.

Additionally, the gas appliances of the gas burner system of the present invention include, but are not limited to, a water heater, a gas fireplace, a gas stove, a gas oven, and a gas dry, as long as the gas appliances are connected to the same main pipe (namely the same gas source G).

It must be pointed out that the embodiment described above is only a preferred embodiment of the present invention. All equivalent structures which employ the concepts disclosed in this specification and the appended claims should fall within the scope of the present invention.

What is claimed is:

1. A gas valve for a gas appliance and communicating with a gas source via a gas pipe, wherein the gas valve comprising:

an inlet channel communicating with the gas pipe;

a check valve body disposed in the inlet channel of the gas valve and comprising an elastic member and a sealing member, wherein the elastic member provides a supporting force to the sealing member to block the inlet channel;

wherein when gas flows toward the gas valve, the gas flow provides a force against the supporting force to move the sealing member, thereby allowing the gas to flow through the check valve body;

wherein the inlet channel has a shoulder; a side of the sealing member abuts against the shoulder, and another side of the sealing member is urged by the elastic member to block the inlet channel; when a force exerted to the elastic member overcomes the supporting force, the sealing member is disengaged from the shoulder to allow gas in the gas pipe to flow through the check valve body;

wherein the check valve body comprises a seat disposed in the inlet channel, an end of the elastic member urges against the sealing member, and another end of the elastic member urges against the seat;

wherein the seat has a perforation, and the check valve body comprises a guided rod; an end of the guided rod is movably disposed in the perforation, and another end of the guided rod is connected to the sealing member; the elastic member is disposed around the guided rod;

wherein the sealing member has a hole, the end of the guided rod connected to the sealing member has a head and a restricting portion; the guided rod passes through the hole, and the sealing member is located between the head and the restricting portion; a diameter of the head and a diameter of the restricting portion are greater than a diameter of the hole of the sealing member, and the diameter of the restricting portion is greater than a diameter of the perforation of the seat.

2. The gas valve as claimed in claim 1, wherein the elastic member is a conical compression spring, and a diameter of the elastic member is gradually increased from the end of the elastic member that urges against the sealing member to the end of the elastic member that urges against the seat.

3. The gas valve as claimed in claim 1, wherein the seat has a protruding column, and the protruding column has the perforation; the elastic member fits around the protruding column.

4. A gas valve for a gas appliance and communicating with a gas source via a gas pipe, wherein the gas valve comprising:

an inlet channel communicating with the gas pipe;

a check valve body disposed in the inlet channel of the gas valve and comprising an elastic member and a sealing member, wherein the elastic member provides a supporting force to the sealing member to block the inlet channel;

wherein when gas flows toward the gas valve, the gas flow provides a force against the supporting force to move the sealing member, thereby allowing the gas to flow through the check valve body;

wherein the gas valve comprises an inlet chamber, an isolating membrane, a spring, a solenoid valve, and an outlet channel; the inlet channel communicates the gas pipe and the inlet chamber, the isolating membrane is disposed in the inlet chamber to divide the inlet chamber into a first part and a second part that communicates with the first part; an end of the spring urges against an internal wall of the second part, and another end of the spring urges against the isolating membrane; the first electromagnetic valve is adapted to regulate a communication between the second part of the inlet chamber and the first outlet channel; a side of the isolating membrane is urged by the spring to block a communication between the first part of the inlet chamber and the outlet channel.

* * * * *